United States Patent [19]

Abt

[11] 4,034,674

[45] July 12, 1977

[54] COMPACT ELECTRICAL FUZE

[75] Inventor: Edgar John Abt, Tempe, Ariz.

[73] Assignee: Motorola, Inc., Schaumburg, Ill.

[21] Appl. No.: 730,040

[22] Filed: Oct. 6, 1976

Related U.S. Application Data

[62] Division of Ser. No. 644,212, Dec. 24, 1975.

[51] Int. Cl.[2] ..... F42C 13/00; F42C 19/02

[52] U.S. Cl. ..... 102/70.2 P

[58] Field of Search ..... 102/70.2 P, 70.2 R

[56] References Cited

U.S. PATENT DOCUMENTS

| | | | |
|---|---|---|---|
| 2,947,255 | 8/1960 | Kuck et al. | 102/70.2 P |
| 3,143,072 | 8/1964 | Dell et al. | 102/70.2 P |
| 3,727,553 | 4/1973 | Godfrey | 102/70.2 P |

*Primary Examiner*—Charles T. Jordan
*Attorney, Agent, or Firm*—M. David Shapiro

[57] ABSTRACT

A small electrical fuze for use with an explosive projectile being subject to very high g forces both in the direction of and opposed to the line of flight. A lead charge is disposed in a barrel rotor whose axis of rotation is normal to the flight path for providing the safing and arming function. A system of controlling drive balls captured in shaped slots on the surface of the barrel rotor in cooperation with straight slots on an interior surface of a mounting cavity provide the necessary forces for a multiple step arming sequence in response to spin-induced forces on the fuze. These multiple step sequences include two direction reversals. A one-fourth wavelength shorted skirt surrounds the fed end of a monopole antenna to isolate the radio frequency currents thereon from the body of the projectile thereby improving the antenna pattern in the direction of trajectory. A shaped single sided flexible printed circuit board provides three mounting planes for mounting and interconnecting all of the electrical components of the fuze. The packaging configuration allows for assembly of the fuze without the use of any threaded devices, thereby enabling low cost automated mass production.

1 Claim, 15 Drawing Figures

FIG. 1
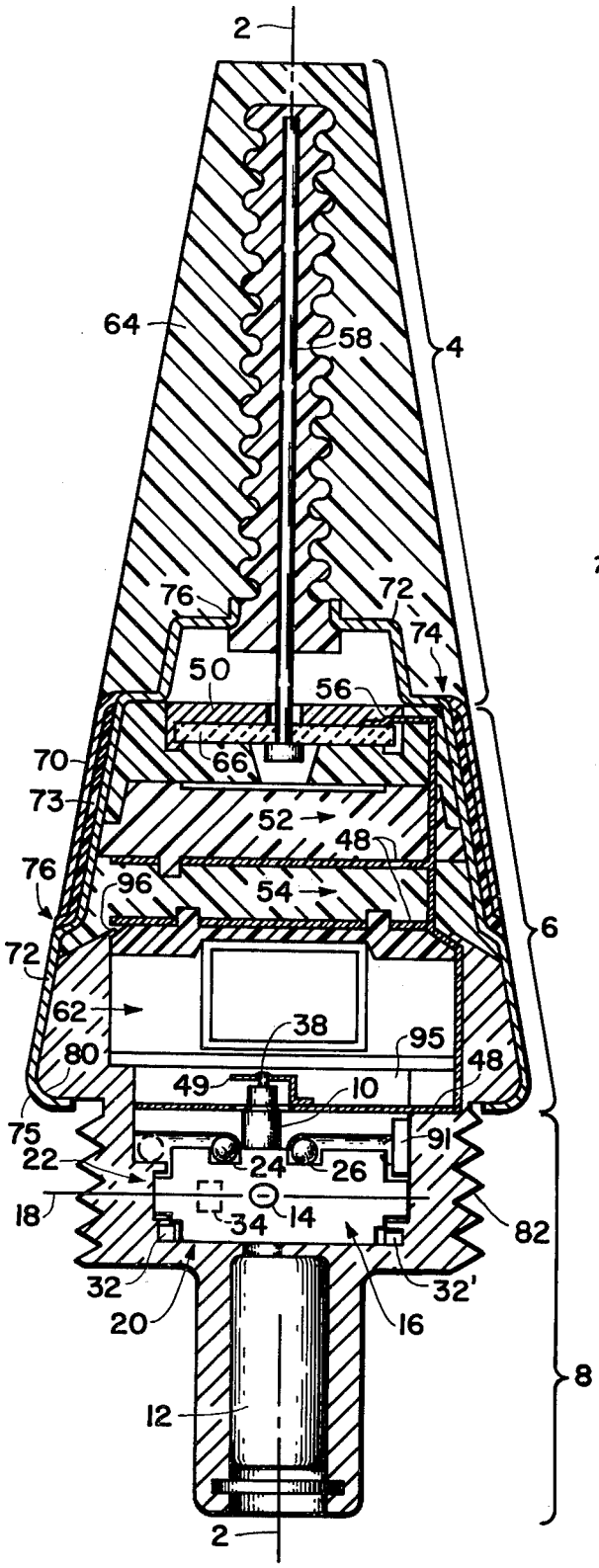
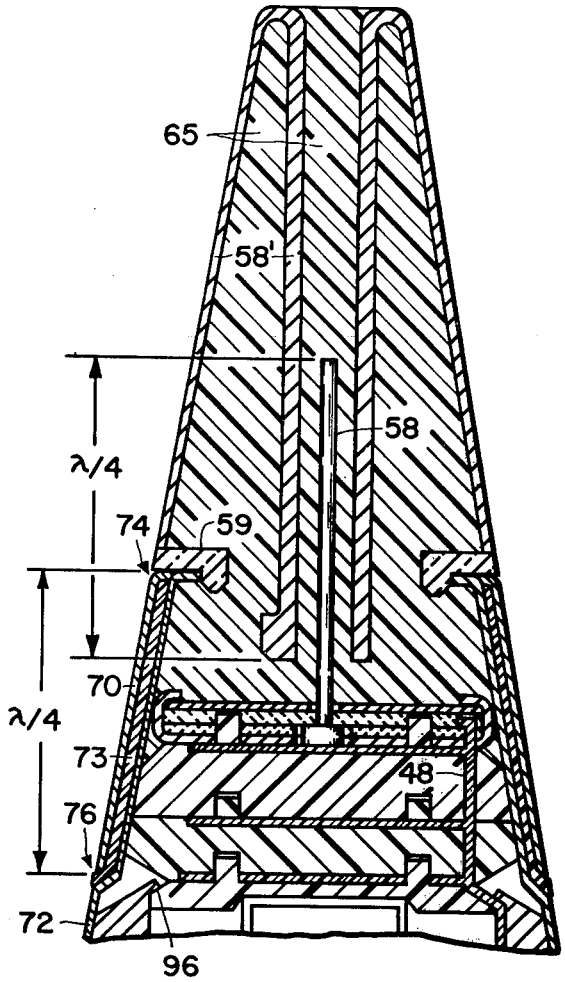
FIG. 1A

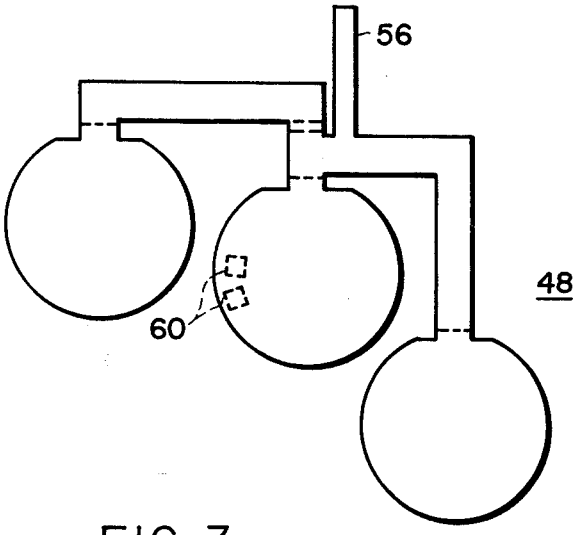
FIG. 3
FIG. 4
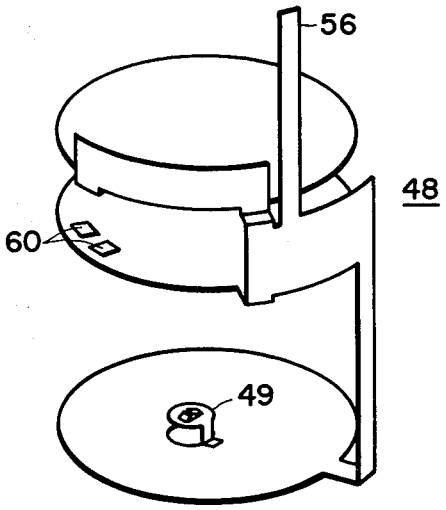

COMPACT ELECTRICAL FUZE

This is a division, of application Ser. No. 644,212, filed Dec. 24, 1975.

FIELD OF THE INVENTION

The invention relates to a system for packaging a compact fuze incorporating maximum safing and arming functions and providing for low cost in high quantity production. The packaging system incorporates features which enchance capability of the fuze to "look" forward. The flexible printed circuit fabricated from a single sheet of material is uniquely shaped to provide mounting surfaces for electrical components in three different planes. The packaging design enables fabrication of the fuze without the use of threaded fasteners. The integrated packaging design is capable of withstanding extremely high acceleration forces in both the positive and negative direction along the axis of flight.

BACKGROUND OF THE INVENTION

Recent improvements in rapid firing weaponry have created complex problems for the fuze designer. Fuze/-projectile combinations are subjected to high intensity axial forces caused by ammunition feeding, chambering and firing in addition to the usual centrifugal or spin forces generated by rifled gun barrels. Fuze design is further complicated by consideration of fuze safety. Users are concerned that the fuze not arm before the projectile travels a safe distance downrange after leaving the gun barrel. Electronic timing circuits used to provide the arming function have historically suffered from lack of reliability and are subject to malfunction causing safety type failures. Typical electronic proximity fuze functions require that two modes of target induced detonation be provided; electronic circuits initiate detonation upon approach of the projectile to the target and impact detonation is usually utilized as a second mode for initiating the explosive train. The proximity function is desired to operate in either of two cases. In either case, the primary mode of operation is on impact. However, if the projectile misses the target, the proximity function should operate and if the target is too "soft" to cause primary impact detonation the proximity mode function should provide the secondary form of detonation. Relatively small caliber electronic fuzes severely limit the volume available to implement the safing and arming function within the constraints imposed by applicable military design specifications. Ball rotors and ball driven disk rotors have been used in small projectile fuzes to retard mechanical arming until the projectile has left the gun tube, but the nominal fuze arming time achieved by these methods is, in many instances, significantly less than that desired. In addition, ball driven disk rotors commonly incorporate explosive elements mounted eccentric to the fuze major axis. This latter condition can be the cause of undesirable rotor imbalance and, in some designs, may require the explosive output to be subsequently transferred to the fuze major axis to facilitate booster initiation. This technique occupies precious volume and proliferates the quantity of explosive elements required between the detonator and the booster charge.

Further, in an electronic proximity fuze, the safing system must be designed so as not to interfere with the functions of the foreward located antenna. This consideration generally precludes the use of a temperature or air flow sensor such as a melting link or propellor device as a safety element in the foreward sector of the fuze. Spin detents and setbacks stops have been utilized to prevent this rotation prior to sensing of centrifugal and set back force environments. Ball driven disk rotors have been utilized wherein the disk might take two safe positions before finally arriving at the armed position. This multiple step arming system has the advantage of taking more time thereby providing more safety in the projectile as a result of providing a greater distance from the gun barrel at the time of arming. It is also more likely to fail in a safe position in case of a malfunction; a desirable feature.

Prior art fuze systems may utilize one of several packaging techniques. Typically, the electrical components are mounted, both electrically and mechanically, to small printed circuit boards which, in turn, are interconnected by soldered or welded wires or printed cables. The multitude of electrical and mechanical interconnections in these configurations tend to limit the reliability and even, in extreme cases, the safety of the system. Human error in fabrication of these complex electronic assemblies adds further to reliability and safety problems.

In fuze designs utilizing electronic radiating systems, a significant amount of radiated power is effectively lost in that the radiation; that is, the beam width angle of the radiating element; is not limited adequately to the flight path direction. Radiating beam width angles are increased by uncontrolled radiation from the projectile body in response to excitation from the intended radiating element.

Since the projectiles herein discussed are used in high speed gun systems, it follows that large quantities of them are produced. Threaded parts pose the dual problems of high part manufacturing costs and high assembly costs. Threaded fasteners are relatively expensive to make and to assemble since they do not lend themselves well to automated factory assembly systems.

SUMMARY OF THE INVENTION

To solve the foregoing and other problems and shortcomings of the prior art, in accordance with the present invention, a ball driven barrel rotor safing and arming system, a flexible single piece multiplane printed circuit board, an integral quarter wave choke skirt and a packaging system utilizing no threaded fasteners are integrated in a fuze package for use with a small caliber projectile.

According to one aspect of the invention, a barrel rotor safing and arming system is employed to allow nominal center line positioning of all elements of the explosive train.

According to another aspect of the invention, a system of drive balls operating in cooperating slots are used to drive a barrel rotor safing and arming system to a plurality of safe positions in alternate directions before ultimately arriving at and being locked into an armed position.

According to still another aspect of the invention, an integral monopole radiating element is used in conjunction with a quarter wave long skirt type choke to avoid radio frequency excitation of the mating projectile body.

According to yet another aspect of the invention, a one piece flexible printed circuit board is used to provide multi-plane mounting surfaces and interconnections thereto for mounting and interconnecting the electrical components of the fuze.

According to a further aspect of the invention, a system of packaging is utilized to allow assembly of the fuze without use of any threaded parts, thus allowing automated mass production of the fuze at a relatively low cost.

These and other aspects of the invention will be more fully recognized and appreciated upon study of the detailed description of the invention which follows and of the drawings, in which:

FIG. 1 is a cross-sectional view through the flight axis of a typical embodiment of the fuze of the invention.

FIG. 1*a* illustrates an alternative embodiment of the antenna of the fuze of FIG. 1.

FIGS. 2*a*, 2*b*, 2*c* and 2*d* illustrate four positions of the barrel rotor safing and arming system of FIG. 1:

FIG. 2*a* shows the barrel rotor in an initial safe position.

FIG. 2*b* shows the barrel rotor in a second safe position.

FIG. 2*c* shows the barrel rotor in a third safe position.

FIG. 2*d* shows the barrel rotor in an armed position.

FIGS. 2*a'*, 2*b'*, 2*c'* and 2*d'* are cross-sectional views of FIGS. 2*a*, 2*b*, 2*c* and 2*d*, respectively.

FIG. 3 shows the printed circuit board of the fuze of FIG. 1 in its original planar condition, without circuit detail.

FIG. 4 shows the printed circuit board of FIG. 3 in the configuration as installed in the fuze of FIG. 1, again with no circuit detail shown.

Figure 6A:
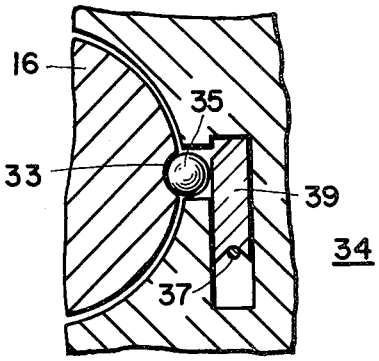
Figure 6B:
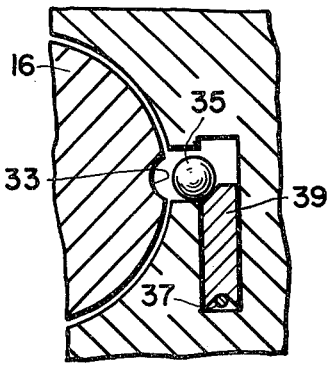

FIG. 6*a* and 6*b* show the details of the setback stop detent on the barrel rotor of FIG. 1.

DETAILED DESCRIPTION OF THE INVENTION

FIG. 1 is a cross-section view of the fuze of the invention, said cross-sectional view being taken through flight axis 2 of the fuze. The fuze may be considered as comprising four basic parts: radiating portion 4, electronics portion 6, explosive train portion 8, and the packaging configuration which provides an integrating structure for the three prior mentioned portions. Explosive train 8 further comprises electric detonator 10 located on or near flight axis 2 of the fuze, booster charge 12, located on flight axis 2 of the fuze and lead charge 14, which may also be a detonator, mounted rotatably between detonator 10 and booster charge 12 in barrel rotor 16. Barrel rotor 16 is rotatable on axis 18 normal to flight axis 2 of the fuze. Barrel rotor 16 is supported within barrel cavity 20 by trunnion mounts 22 located at the axial extremities of barrel rotor 16. Barrel rotor 16 may take one of four rotary positions. The initial position (See FIG. 2*a*) is a safe position which positions lead charge 14 75° out of line from centerlines of detonator 10 and booster charge 12. The second safe position of barrel rotor 16 (see FIG. 2*b*) places lead charge 14 30° out of line with detonator 10 and booster charge 12. A third safe position of barrel rotor 16 (see FIG. 2*c*) places lead charge 14 ninety degrees out of line with detonator 10 and booster charge 12. The fourth position of barrel rotor 16 (see FIG. 2*d*) places lead charge 14 in an armed position, that is, in line with detonator 10 and booster charge 12. When lead charge 14 is in line, it almost completely fills the space between detonator 10 and booster charge 12. As shown in the four views of FIG. 2, drive balls 24, 26 are used in cooperative slots 28, 30, 28', 30' in the forward surface of barrel rotor 16 and the corresponding inner surface of cavity 20 to urge barrel rotor 16 into each of the three positions following the first safe position. Dotted lines 28' and 30' are slots for guiding drive balls 24, 26. They are located on the inner surface of cavity 20 shown in FIGS. 2*a'*, 2*b'*, 2*c'* and 2*d'*. A setback stop 34 (see FIG. 6) cooperatively arranged between barrel rotor 16 and barrel cavity 20 is utilized to prevent rotation of barrel rotor 16 prior to application of setback forces caused by firing the projectile/-fuze combination.

Ball 35 is held in detent cavity 33 of barrel rotor 16 see FIG. 6*a* detail, by member 39. Member 39 is held in a forward position by straight spring 37 until, under the influence of a setback force caused by firing of the projectile, member 39 is urged into the position shown in FIG. 6*b*. Ball 35 in cavity 33 prevents rotation of barrel rotor 16 prior to firing, but is released to move outwardly and away from barrel rotor 16, allowing barrel rotor 16 to be uninhibited by setback stop 34 after firing.

Detonator 10 may be fired electrically via pin 38 from electronic portion 6 of the fuze for either proximity function or "soft" target impact function. Alternately, lead charge 14 may be fired on hard target impact by direct interaction with the target. Electric detonator 10 of this embodiment of the invention does not fire in the impact mode. Lead charge (or detonator) 14 provides this function. However, in an alternate embodiment, a piezoelectric device (not shown), may be used to fire electric detonator 10 in response to impact. Explosive train 8 is arranged, as is well known in the art, so that booster charge 12 will not fire unless lead charge 14 is in line between detonator 10 and booster charge 12. Any of the three safe positions (See FIG. 2) of lead charge 14 will inhibit firing of booster charge 12 even though detonator 10 may be initiated. Use of barrel rotor 16 with rotation on axis 18 normal to flight axis 2 allows detonator 10 to be placed on the nominal center line 2 of the fuze in line with booster charge 12 as may be readily seen from FIG. 1. Booster charge 12 may have to be on the center line 2 of the fuze because of physical configuration of some standard projectiles.

Figure 2A:
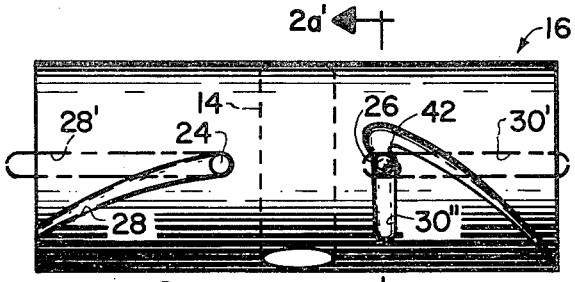
Figure 2A:
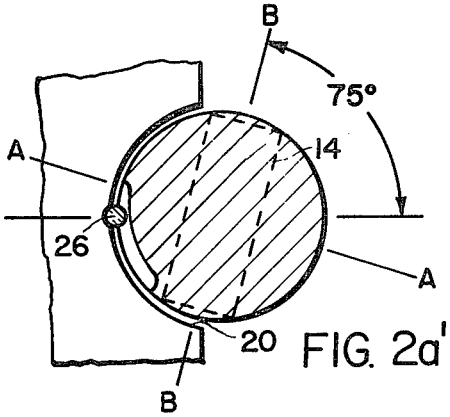
Figure 2B:
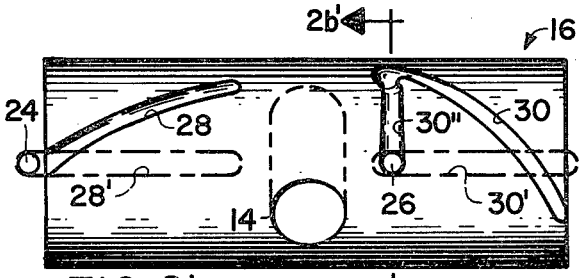
Figure 2B:
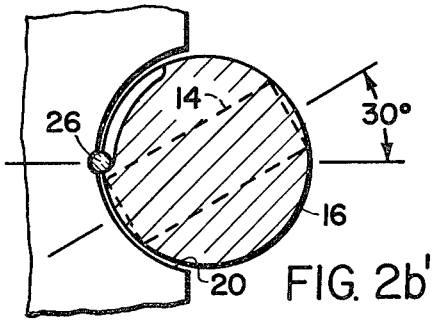

The operation of barrel rotor 16 containing lead charge 14 provides the safing and arming function required in any modern projectile/fuze combination. As initially assembled, barrel rotor 16 is positioned and locked by spin detents 32, 32' and by setback stop 34 in a position such that lead charge 14 is 75 degrees out of line with detonator 10 and booster charge 12 as is shown in FIG. 2*a*. (This 75° position is also the position shown in FIG. 1.) When the fuze/projectile combination is fired in the gun barrel, setback forces cause setback stop 34 to disengage, thus removing this impediment to rotation of barrel rotor 16. As the fuze/-projectile combination accelerates in the gun barrel, rifling features on the inner surface of the gun barrel cause the fuze/projectile to spin. The ensuing rotational force causes spin detents 32, 32' to move outward and disengage barrel rotor 16. Barrel rotor 16 is then free to rotate except that very high acceleration forces cause barrel rotor 16 to be held in a fixed position by means of the friction between barrel rotor 16 and surrounding barrel cavity 20. The magnitude of the acceleration force derived from propellant gases decreases to zero as the fuze/projectile combination leaves the end of the gun barrel, and an axial acceleration force in the opposite direction is subsequently impressed on the fuze/-projectile combination by virtue of the air drag associated with free flight of the vehicle. As the acceleration force changes direction, barrel rotor 16 moves toward the forward end of barrel cavity 20 and, in so doing, barrel rotor 16 becomes suspended on trunnion mounts 22. In this condition barrel rotor 16 is free to rotate about axis 18 within the limits of motion prescribed by the action of drive balls 24, 26 operating in cooperating slots 28, 28', 30, 30'. An examination of FIG. 2*a* together with consideration of FIG. 1 will help the reader to understand how drive balls 24, 26 plus the weight distribution characteristics of barrel rotor 16 provide the necessary rotational forces. It will be apparent that each of drive balls 24, 26 is urged away from flight axis 2 of the fuze as a result of centrifugal force applied by the spinning motion of the fuze/-projectile combination. Drive ball 26 is restricted from outward motion by its position in dwell track portion 30'' in the surface of barrel rotor 16. It should be noted that in this initial position of barrel rotor 16, drive ball 26 prevents motion in one direction of barrel rotor 16 by reason of projection 42 in drive ball 26 slot 30''. Drive ball 24, however, is free to move outboard and in so doing urges barrel rotor 16 to rotate in a direction toward an armed position. It will be noted that projection 42 prevents drive ball 26 from being engaged by the curved portion of track 30. This does not inhibit the relative motion of drive ball 26 in straight track portion 30''. Therefore, barrel rotor 16 rotates from the initial safe position of FIG. 2*a* to the second safe position of FIG. 2*b*, a total of 45°, wherein lead charge 14 is 30° out of line with detonator 10 and booster charge 12. Barrel rotor 16 is stopped in this new position as a result of drive ball 26 being stopped at the end of dwell track 30''. Drive ball 24 at this point is completely out of slot 28 in the surface of barrel rotor 16 and is contained in the barrel cavity 20 outside of barrel rotor 16. Drive ball 24 is retained in this position by centrifugal force and has no further effect on the system.

Figure 2C:
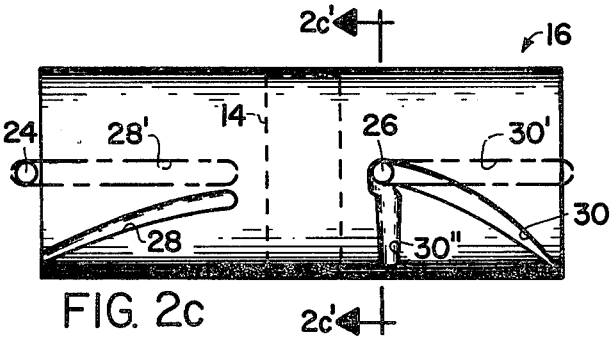
Figure 2C:
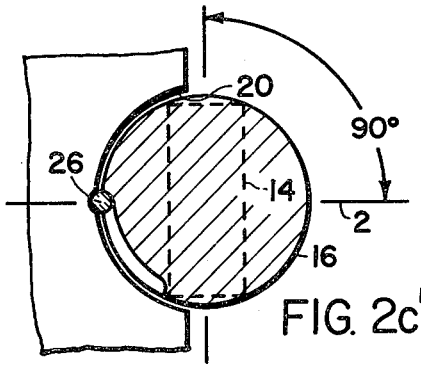
Figure 2D:
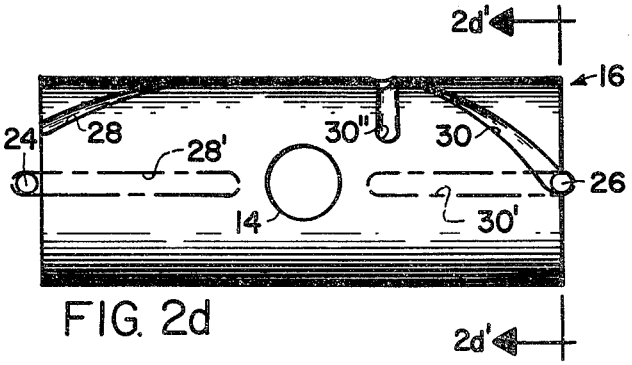
Figure 2D:
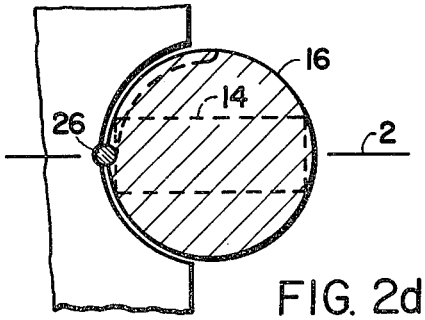

Barrel rotor 16 is constructed with an imbalance built therein. This imbalance takes the form of extra mass concentrated near the outer surface of barrel rotor 16 adjacent the ends of detonator 14 so that the moment of inertia of barrel rotor 16 about plane BB of FIG. 2*a'* is greater than the moment of inertia of barrel rotor 16 about plane AA of FIG. 2*a'*. This imbalance, together with centrifugal force, causes barrel rotor 16 to be urged in a direction back towards the original safe position of the rotor. Note that drive ball 26 has no effect on the rotation of the barrel rotor since it is contained within straight portion 30'' of the drive ball slot and is unable to move away from flight axis 2. The centrifugal force and the imbalance built into barrel rotor 16 causes barrel rotor 16 to rotate in a reverse direction, to a position away from the armed position by a full ninety degrees (see FIG. 2*c*). During this traverse the restraining effect of projection 42 in drive ball 26 slot 30 is overcome by the inertia of barrel rotor 16 motion. The resultant end point of this new rotation is as shown in FIG. 2*c*. Barrel rotor 16 has rotated sixty degrees toward and past the initial safe position and lead charge 14 is now ninety degrees out of line with detonator 10 and booster charge 12 (see FIG. 2*c*). However, in the position as shown in FIG. 2*c*, there is no restrictive force on drive ball 26 to prevent it from moving outboard, just as drive ball 24 did in the first instance. Drive ball 26 is urged outward by spin forces and, in so moving, causes barrel rotor 16 to proceed to a fourth or armed position (see FIG. 2*d*) wherein lead charge 14 is in line with detonator 10 and booster charge 12. This is the result of cooperation between the centrifugal urging of drive ball 26 outward and the shape of drive track portion 30 in the surface of barrel rotor 16 and straight track 30' in the inner surface of barrel cavity 20. Centrifugal force holds drive ball 26 in the position as shown in FIG. 2*d* thereby locking barrel rotor 16 in this position. Lead charge 14 has rotated a full 90° to an inline position between detonator 10 and booster charge 12 and the fuze is now armed and ready to initiate.

Note that the prime purpose of projection 42 located at the intersection of tracks 30, 30'' is to prevent barrel rotor 16 from rotating in such a direction as to prematurely permit ball 26 to enter track 30 in the event that drive ball 24 is inadvertently omitted at assembly. In the event that drive ball 26 is omitted at assembly but drive ball 24 is properly assembled, the mechanism will operate until the barrel rotor position of FIG. 2*c* is attained, then barrel rotor 16 will move no further, since, in the absence of drive ball 26, there is no urging of rotor 16 beyond this point. In the event that both drive balls 24, 26 are omitted at assembly, barrel rotor 16 will seek the position of FIG. 2*c* and remain there under the influence of spin forces.

A detonator may be carried in barrel rotor 16 in lieu of lead charge 14, depending on the explosive energy output available from electric detonator 10, and upon other factors peculiar to any specific application. For example, in some applications, an electric primer may be utilized in conjunction with a detonator in the location of lead charge 14 in place of using electric detonator 10 in conjunction with detonator or lead charge 14.

Figure 5:
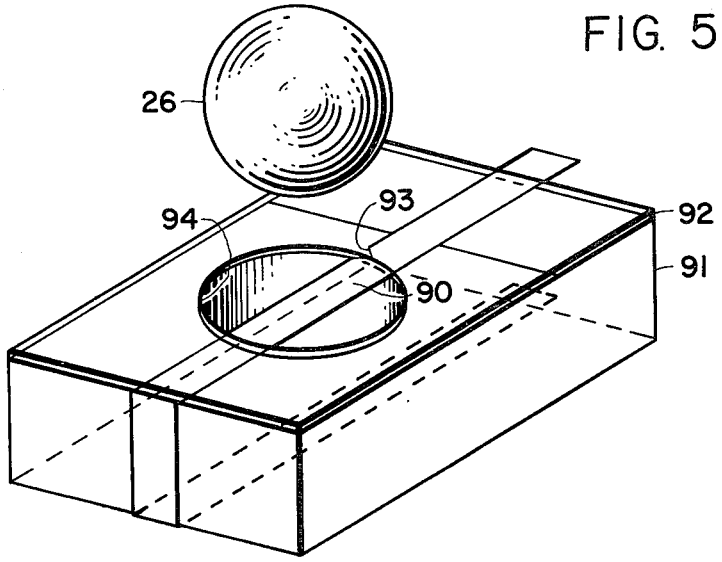
FIG. 5 illustrates the detail of the structure of the dielectric detonator shorting switch of FIG. 1.

In the interest of safety, users customarily require that electric detonators be short circuited until the fuze is armed. The short circuit of detonator 10 is accomplished by electrically conductive ribbon 90 (See FIG. 5) mounted on dielectric base 91. A layer of dielectric material 92 is applied over base 91 and conductive ribbon 90. Hole 94 diameter is larger than the diameter of ball 26 (FIG. 1). The leads of the assembly of FIG. 5 are attached to electronic circuit 48 (FIGS. 1 and 4) in a manner assuring the short circuit of electric detonator 10. At assembly, hole 94 is aligned with the path of drive ball 26 (FIGS. 1 and 2) or with an auxilliary ball (not shown) so that, when spin forces urge drive ball 26 outwardly and the armed position of barrel rotor 16 is attained (FIG. 2*d*), drive ball 26 irreversably ruptures ribbon 90. Notch 93 helps assure complete rupture of ribbon 90. The rupture, once complete, cannot be restored and the short circuit of electric detonator 10 is removed. Drive ball 26 is contained partially within hole 94 by the spin force, thus capturing a portion of ribbon 90 therein, as well.

In summary, it will be seen that barrel rotor 16, which controls the position of lead charge 14, remains in the initial safe position (FIG. 2*a*) until the fuze/projectile leaves the gun barrel. It is initially locked in position by spin detents 32, 32' and setback stop 34. When setback force removes setback stop 34 and centrifugal force removes spin detents 32, 32'; barrel rotor 16 is free to rotate except for the frictional forces which hold it in place in barrel cavity 20 during acceleration. These frictional forces decrease to a low magnitude when the fuze/projectile combination leaves the gun barrel. Centrifugal force then is used to urge three distinct rotational steps (FIG. 2*b*, 2*c* and 2*d*) in the arming sequence. Each of these steps takes a finite period of time thereby providing a relatively protracted total arming time. The total arming time period is further lengthened by the reversal in direction of barrel rotor 16 at steps shown by FIG. 2*b* and 2*c*, requiring barrel rotor 16 to execute a total angular motion significantly greater than the angular displacement between the original position (FIG. 2*a*) and the final armed position (FIG. 2*d*). Each reversal of barrel rotor 16 represents the utilization of energy to overcome the inertia of barrel rotor 16. The mass and mass distribution of barrel rotor 16 is preferably adjusted by design to control the time period in each instance.

The preceding description of the safing and arming system of the fuze of the invention is illustrative of one embodiment only. It will be apparent to one skilled in the art that variations of this embodiment may be employed. For example, the specified angular rotations of rotor barrel 16 may be deviated from without affecting the basic principle of the invention.

Referring to FIG. 1 it will be seen that one piece circuit mounting and interconnecting system 48 is utilized. FIG. 3 illustrates circuit member 48 in its initial planar form. Circuit member 48 is a flexible printed circuit board. It is constructed on a thin flexible dielectric base having printed circuit metallic elements (not shown) disposed upon one side thereof. Since it is initially of a planar form all of the electrical components (not shown) of the system may be mounted thereon, preferably by soldering prior to shaping of circuit member 48 and installation thereof in the fuze. Flexible printed circuit 48 in planar form may have all electronic components mounted thereon, and it may be tested prior to installation in the fuze. Circuit member 48 provides for all interconnections between the electronic components (not shown) mounted thereon, thus eliminating handwiring between said electronic components.

After testing, circuit member 48 may be bent or folded to the shape as shown in FIG. 4. Protective spacing elements 52, 54, 95 of FIG. 1 may then be installed between the electrical component mounting levels of circuit member 48. Protective elements 52, 54, 95 may be made of plastic or other nonconductive materials and are used to hold the relative positions of the mounting planes of circuit board 48, the electrical components mounted thereon, and the interconnecting element portions in place during the very high g forces which are encountered during insertion of the fuze/projectile combination in the gun barrel and firing therefrom. Protective elements 52, 54, 95 of FIG. 1 may be molded with cavities therein for filling the interstitial volumes between adjacent sections of the board and of electronic components thereon. As may be seen from FIGS. 3 and 4, circuit board 48 configuration includes connections to two other major elements which are not mechanically mounted to the board. Tab 56 includes an electrical connection for antenna element 58 (to be described later) and circuit pads 60 accommodate one or more electrical connections from battery 62 (illustrated in FIG. 1). Referring again to FIG. 4, it will be noted that included in the lower section of printed circuit board 48 there is a press fit connection 49 to detonator 10, as shown in FIG. 1. Therefore, it may be seen that circuit board 48 of FIGS. 3 and 4 provides integral electrical connections to all of the electrical elements of the fuze. The integral nature of circuit board 48 provides a means for automated production and assembly of the fuze system thus contributing to low cost.

The Radio Frequency (RF) radiating element of the fuze, antenna 58, is located within a protective sheath 64 in the forward part of the fuze. One embodiment of the antenna is shown in FIG. 1, an alternative embodiment is shown in FIG. 1*a*. In FIG. 1, protective sheath 64 acts both as an electrical radome and provides the required aerodynamic entry shape for the leading portion of the fuze/projectile. Disk 66 is provided at the base of antenna 58 which comprises a dielectric with a microstrip circuit thereon. Disk 66 is electrically and mechanically connected to metallic support 50 which is in turn electrically connected to fuze structural member 72. The microstrip circuit is electrically connected to the base of the antenna 58 and to tab 56 on circuit board 48. This provides the necessary RF electrical drive from electrical portions 6 of the system to antenna 58. If no further provision were made, the electromagnetic radiation from antenna 58 would act to electromagnetically excite the body of the projectile (not shown) thus tending to reduce radiation in the desired or forward direction, that is, along flight path axis 2 of the fuze/projectile combination. Therefore, in order to isolate the body of the projectile from radiation of antenna 58, skirt element 70 is employed. Conducting skirt 70 is electrically connected to fuze structural member 72 at point designated 74. Aft end 76 of skirt 70 is left unconnected electrically or as an open circuit. The space between skirt 70 and structural member 72 is filled with dielectric 73. The distance from point 74 to the after end of skirt 70 at 76, is arranged to be an electrical quarter wavelength long, as measured within dielectric 73, at the frequencies radiated by antenna 58. Thus, the assembly of skirt element 70 and structural member 72 creates a quarter wavelength long electrical choke for isolating the body of the projectile (not shown) from antenna 58. This arrangement enhances the amount of radiated power in the forward direction.

FIG. 1*b* illustrates an alternate embodiment of the antenna wherein skirt element 70 and dielectric 73 perform the same function as in FIG. 1A. In the embodiment of FIG. 1*b*, antenna 4 comprises driving element 58 and driven element 58′. Plastic or ceramic spacer ring 59 acts to separate antenna element 58′ from skirt element 70. Dielectric 65 bonds antenna 4 in an integral unit.

Structural member 72 of the fuze is configured to contain the various elements of the fuze without utilization of threaded connections. The shape of structural element 72 locks it into the mating portions of the fuze at forward end 74. Structural element 72 is initially manufactured with a straight section (not shown) at point 75. Structural member 72 is initially locked to antenna structure 4 by molding sheath or radome element 64 or dielectric 65 around it. The aft section of the fuze, containing the mechanical portions thereof including safing and arming system and explosive train 8, are contained in the interstitial volume between electrical portion 6 and structural member 82. A crimp joint at location 96 retains all fuze elements aft of that point and foreward of booster 12. The last assembly operation comprises the rolling of aft end 75 of structural member 72 inboard to engage projection 80 on mating structural member 82.

In summary, it will be seen that with the exception of the booster assembly, only two crimping operations are required to completely assemble the fuze structurally. It will also be seen that there are no threaded connections made in the process.

What has been described is one embodiment of the invention. Various other modifications and changes may be made to the present invention from the principles of the invention described above without departing from the spirit and scope thereof as encompassed in the following claims.

What is claimed is:

1. In an electrical fuze for a projectile, having an electrical circuit, the improvement comprising:

conductor means;

a plurality of electrical components; and dielectric means being fabricated from a unitary thin planar flexible material, said conductor means being disposed on only one side of said dielectric means, said disposed conductor means and said dielectric means being shaped and bent to provide mounting for said plurality of electrical components in a plurality of mounting planes.

* * * * *